US007350690B2

(12) United States Patent
Fitzgibbons et al.

(10) Patent No.: US 7,350,690 B2
(45) **Date of Patent: *Apr. 1, 2008**

(54) METHOD AND APPARATUS FOR CONTAINING MAIL ARTICLES DEPOSITED IN A MAIL DROP BOX

(75) Inventors: Patrick J. Fitzgibbons, Owego, NY (US); John Hoover, Owego, NY (US); Glenn L. Kehley, Owego, NY (US); John T. Swider, Owego, NY (US); Mary B. Wilcoxen, Owego, NY (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/673,103

(22) Filed: Feb. 9, 2007

(65) Prior Publication Data

US 2007/0158400 A1 Jul. 12, 2007

Related U.S. Application Data

(62) Division of application No. 10/851,389, filed on May 21, 2004, now Pat. No. 7,175,068.

(60) Provisional application No. 60/479,536, filed on Jun. 18, 2003, provisional application No. 60/472,920, filed on May 23, 2003.

(51) Int. Cl.
*A47G 29/12* (2006.01)

(52) U.S. Cl. ..... 232/30; 232/43.2; 232/45

(58) Field of Classification Search ..... 232/30–32, 232/43.2, 45, 17; 220/23.87, 23.89, 908, 220/908.1; 383/59, 61.1, 61.4, 71–76
See application file for complete search history.

(56) References Cited

U.S. PATENT DOCUMENTS 237,315 A 2/1881 Paul (Continued)

FOREIGN PATENT DOCUMENTS

JP 1127087 5/1989

OTHER PUBLICATIONS

U.S. Postal Service Emergency Preparedness Plan for Protecting Postal Employees and Postal Customers from Exposure to Biohazardous Material etc.; Mar. 6, 2002; publ. by USPS.

*Primary Examiner*—William L. Miller
(74) *Attorney, Agent, or Firm*—Burns & Levinson LLP; Jacob N. Erlich; David W. Gomes

(57) ABSTRACT

A mail box configured to contain and reduce exposure to hazardous particulates, which includes a container having a deposit port at an upper end and a collection chamber at a lower end. There is at least one door at the upper end for mail to be placed into the deposit port. A normally open sealable bag is located in the collection chamber for receiving mail and for being sealed when the mail is to be removed from the container. There is a bag holder constructed and arranged to hold a bag in place and normally open so that in a first position, mail placed into the deposit port falls downwardly through the bag holder and into a bag in the collection chamber and which bag may be preliminarily sealed while in this position, and in a second position, the bag may be more securely sealed and removed from the bag holder. The bag holder is movable from its first position in which the bag is within the collection chamber to the second position in which the bag is outside of the collection chamber and includes two open frames hinged together for removably holding the top of a bag. The bag holder has an upper frame and a lower frame which are arranged so that the top of an open bag may be clamped between the upper and lower frames to hold an open bag in place in the collection chamber.

18 Claims, 12 Drawing Sheets

U.S. PATENT DOCUMENTS

| | | | | |
|---|---|---|---|---|
| 358,632 | A | 3/1887 | Teller | |
| 378,955 | A | 3/1888 | Dubey | |
| 718,717 | A | 1/1903 | Marx et al. | |
| 787,476 | A | 4/1905 | Sheley | |
| 1,027,524 | A | 5/1912 | Cook | |
| 1,451,343 | A | 4/1923 | Panagopolous | |
| 2,421,221 | A | 5/1947 | Rothe | |
| 3,790,244 | A | 2/1974 | Stackhouse | |
| 3,817,448 | A | 6/1974 | Schneider | |
| 3,982,690 | A | 9/1976 | Krizan et al. | |
| 4,363,438 | A | 12/1982 | Connor | |
| 4,785,960 | A | 11/1988 | Belisle | |
| 5,050,743 | A | 9/1991 | Lazzarotti | |
| 5,101,983 | A | 4/1992 | Scata | |
| 5,233,532 | A | 8/1993 | Ramsden | |
| 5,330,174 | A | 7/1994 | Ricciardi | |
| 5,340,948 | A | 8/1994 | Ramsden | |
| 5,508,818 | A | 4/1996 | Hamma | |
| 5,535,874 | A | 7/1996 | Ross et al. | |
| 5,656,799 | A | 8/1997 | Ramsden et al. | |
| 5,842,693 | A | 12/1998 | Stevens et al. | |
| 6,135,265 | A | 10/2000 | DiSaverio et al. | |
| 6,244,505 | B1 | 6/2001 | Grimes et al. | |
| 6,259,967 | B1 | 7/2001 | Hartlepp et al. | |
| 6,347,737 | B1 | 2/2002 | Madruga | |
| 6,477,514 | B1 | 11/2002 | Gil et al. | |
| 6,523,697 | B1 | 2/2003 | Malatesta et al. | |
| 6,579,053 | B1 | 6/2003 | Grams et al. | |
| 6,742,703 | B2 | 6/2004 | Esakov et al. | |
| 6,892,934 | B2 * | 5/2005 | Avant | 232/30 |
| 6,953,148 | B2 * | 10/2005 | Esakov et al. | 232/30 |
| 7,040,529 | B2 * | 5/2006 | Swider et al. | 232/45 |
| 7,175,068 | B2 * | 2/2007 | Fitzgibbons et al. | 232/31 |
| 7,198,749 | B2 * | 4/2007 | Avant | 422/3 |
| 7,234,633 | B2 * | 6/2007 | Day et al. | 232/30 |
| 2001/0011796 | A1 | 8/2001 | Hendrickson et al. | |
| 2002/0007281 | A1 | 1/2002 | Gil et al. | |
| 2002/0164214 | A1 | 11/2002 | Meeks | |
| 2003/0039516 | A1 | 2/2003 | Meeks | |
| 2003/0103866 | A1 | 6/2003 | Wang et al. | |
| 2003/0106929 | A1 | 6/2003 | Day et al. | |
| 2003/0209595 | A1 * | 11/2003 | Felice et al. | 232/45 |
| 2003/0222132 | A1 | 12/2003 | Esakov et al. | |

* cited by examiner

METHOD AND APPARATUS FOR CONTAINING MAIL ARTICLES DEPOSITED IN A MAIL DROP BOX

CROSS-REFERENCE TO RELATED APPLICATIONS

This application is a division of parent application Ser. No. 10/851,389 filed May 21, 2004, and now U.S. Pat. No. 7,175,068, and the priority of such application is claimed and the entire content thereof is incorporated herein by reference.

The present application is based upon and claims the priority of Provisional Application Ser. No. 60/472,920 filed May 23, 2003 and Provisional Application Ser. No. 60/479,536 filed Jun. 18, 2003, the contents of both applications are hereby incorporated here in by reference.

STATEMENT REGARDING FEDERALLY SPONSORED RESEARCH OR DEVELOPMENT

This invention was made partially with U.S. government support from the U.S. Postal Service under contract No. 512593-02-B-2820. The U.S. government has certain rights in the invention.

BACKGROUND OF THE INVENTION

The present invention relates to a system and method for protecting post office personnel and customers from hazardous materials on or inside mail articles and, more particularly, to providing such protection in mail boxes.

All economies depend upon the physical shipment of materials for their functioning including the shipment of mail, merchandise, raw materials, and other goods.

Terrorist activities in the United States have caused an urgent need for a means of protecting the U.S. Postal Service mail carriers as well as the general public from contaminates placed in the "collection mail." There are currently no means available which provide the appropriate protection which is required.

U.S. Pat. No. 237,315 discloses a letter box having a mail bag inside.

U.S. Pat. No. 358,632 discloses a letter box with a pouch inside.

U.S. Pat. No. 378,955 discloses a letter box arranged to prevent a person placing a hand inside the box.

U.S. Pat. No. 718,717 discloses apparatus for receiving and collecting mail arranged to be opened only when a letter-collecting bag is attached to it.

U.S. Pat. No. 787,476 discloses a mail box having a bag which is locked when it is removed from the box.

U.S. Pat. No. 1,027,524 discloses a mail bag and bag support having means for supporting the bag in open position.

U.S. Pat. No. 1,451,343 discloses a mail receptacle having a pouch to receive the mail.

U.S. Pat. No. 2,421,221 discloses a letter box in which a mail bag may be inserted into the letter box and placed into open condition, and closed when the mail is to be removed.

U.S. Pat. No. 3,790,244 discloses a mailbox unit which provides for delivery of packages near the conventional letter box.

U.S. Pat. No. 3,817,448 discloses a garbage receptacle arranged to hold a sack open over a frame and there are draw stings attached to a slide.

U.S. Pat. No. 3,982,690 discloses a mail box container which is inserted into a mail collection box to receive the mail.

U.S. Pat. No. 4,363,438 discloses a mail box having a mail bag holding frame which holds the mailbag in open position and mounted on a holding frame carries on a slide structure.

U.S. Pat. No. 4,785,960 discloses a mailbox security bag which is a pouch with an open mouth and a strap is used to close the bag.

U.S. Pat. No. 5,050,743 discloses a combined sack and tray system for mail collection which can hold sacks and trays of different sizes.

U.S. Pat. No. discloses a device for identifying and sorting objects.

U.S. published patent application, Pub. No.: US 2003/0106929 discloses an arrangement for the securing and handling of mail which provides for a worker, upon retrieving mail from a mailbox, to dose the bag.

SUMMARY OF THE INVENTION

It would be advantageous to be able to isolate items dropped into mail boxes and other public drop boxes, so that adequate testing may be performed to detect the presence of any contaminants before the items in the boxes are exposed to ambient conditions and to workers and customers.

The present invention includes three components:

1. A mail box, which can be the free standing type (e.g., snorkel box or standard collection box) or a wall mounted lobby box;
2. a slidable shuttle assembly for holding a mail bag; and
3. a mail bag or container.

The present invention may be provided when constructing a new mail box, or may be retrofit into existing mail boxes. A sealed path is provided from the customer letter drop slot through the slidable shuttle assembly which holds the bag.

The letter drop slot is altered to have a swinging flap that is pushed open during the customer's mail insertion process. The purpose of this is to prevent the possibility of a back draft of air, carrying a contaminate back into the customer's face.

In one embodiment, a mail box includes a rigid housing or container forming an opening for depositing mail items, and a slidable shuttle assembly adapted to attach a flexible bag to the housing for receiving deposited mail items. The shuttle assembly includes a pair of open frames (an upper frame and a lower frame) hinged together to pinch a peripheral edge a bag which is open and the top edges of which are passed through the opening of the lower frame and then around the outside of the lower frame, and the upper frame is moved against the lower frame to hod the bag mouth open and in place, and the bag is sealed to the frame.

The frames are mounted to a sliding mechanism adapted to allow the frame assembly to move laterally clear of the housing. The upper frame includes a shutter for closing the bag or flexible container. The shutter may be constructed of transparent material to allow visual inspection into the bag without opening the shutter.

The bag or flexible container may include a cinching member located to close the opening of the container while the container is still attached to the shuttle assembly. The bag may also include an implanted draw cord in proximity to the peripheral edge. The upper frame may be adapted for attachment to the draw cord to pull on the draws cord when the upper frame is removed from the lower frame. The bag may also include a vent attached to a filter for safely venting excess air from the bag while retaining particulate contaminants within the bag.

Particularly in a lobby type of box, an additional mail path cover is fitted over the back (non-customer side) of the lobby box. This is to keep the inducted mail piece completely isolated from Postal or other workers that are in the area. It may be necessary to add an internal angled guide to allow the letter mail to be guided in a manner such that it does not hang up or lodge inside the lobby box and that it travels a smooth path to the mail path cover. It may be necessary to remove the current hinged back door and associated hardware (such as door closure magnets or brackets). The mail path cover can be fabricated or molded of a clear material such as polycarbonate. It can have a access door in the unlikely event that a mail jam occurs and it needs to be physically cleared by a postal or other authorized person.

The bottom of the mail path cover and joining the lobby box is a mail director that acts as a funneling device, to direct mail as a customer deposits it, into the center of the slidable shuttle assembly. It also acts to direct parcels inducted through the lobby box parcel door into the same mail container.

The slidable shuttle assembly is on slides that in the closed position, accepts mail as funneled by the mail director and passes it, via gravity, to the mail bag below. It also supports and holds the mail bag open so that it can accept mail in an unimpeded manner. This slide shuttle assembly is usable for free standing drop boxes well as lobby drop boxes.

Attached to the slidable shuttle assembly is a bag holding or clam shell assembly. The bag holding assembly is a hinged frame that is comprised of an upper and lower open frames members. The upper frame is mounted to a hinge at the rear side of it that allows it to swing upwardly. Because of the manner that the upper and lower bag holding frames mate to each other and the ability of the upper frame to hinge open, it is possible to nest and seal a bag between the two. The upper frame has a sliding shutter plate incorporated into it that, when pushed closed, will stop the mail from descending into the bag prior to the removal process of the mail bag at collection time. This helps to prevent any air flow that may contain suspended contaminates from escaping the mail bag while the operator is seating the mail container.

There can also be a second shutter plate in-between the slide access mechanism and the mall director. This would be beneficial in the event that mail is being inducted by a customer at the same time the mail container is being serviced by a postal worker. The clamshells and shutter plate have seals to help ensure that possible contaminates from within the mail container, stay within the mail container. The shutter plate can be made of a transparent material to help view the mail internal to the mail container prior to sealing of the mail container. The shutter plate also can be hinged to allow it to stow in a near vertical position when the system is in use for collection.

The slidable shuttle assembly strategically positions a mail bag directly under the lobby drop box, or under the deposit port in a free standing box. It is comprised of a set of industrial drawer slides and a supporting bracket. The drawer slides are appropriately load rated and have sufficient cycle rating to last the lifetime of a collection box. This allows the servicing of the mail bag to take place in the necessary ergonomic manner. Hard fastened directly to the drawer slides is a supporting bracket. The supporting bracket spans the two drawer slides and provides a means of rigidly attaching the bag holding frames to the drawer slides. The slidable shuttle assembly can firmly seat closed and a magnet or some other detent type device is used to accomplish this.

All of the hardware and apparatus are engineered using industrial quality parts since mail is sometimes collected in extreme and harsh environments and the parts are workable in extremes of temperature and humidity.

The mail bag is an engineered bag that may be reusable or disposable. It has many necessary features to allow it to work as a system component of the Collection Mail Containment System (CMCS). The mail bag is made of a rugged, but flexible, non-porous material. Attached to the upper portion of the mail bag is a cable tie or similar device that is used to pinch the bag closed and seal it. The cable tie can have a double-headed end such that it can be looped twice. This will be explained in more detail below. As the cable tie is being closed, air will want to exit the mail bag. The shutter plate blocks the exit of air from the top of the bag at the container interface so the air will exit through a built in HEPA filter in the mail bag. With the cable tie drawn completely closed the bag holding frame assembly can now be opened for removal of the mail bag. At the top of the mail bag is a draw string that is of a predetermined length such that it can be looped over a handle on the upper frame member, which is a feature of the bag holding frame assembly. By doing such, the motion of opening the bag holding frame assembly will allow the draw string to close off the top of the bag. This prevents an operator from physically touching the upper inside area of the mail container that may have had a contaminated article pass over it. At this point the draw string can be grasped and the mail bag removed from the mailbox. With the mail bag removed a second seal can be made to finalize the closure of the mail bag. This is accomplished by bending the drawn closed end of the mail bag downwardly in a gooseneck fashion. The second slot of the double ended cable tie can now be utilized to perform a second looped closure.

Other features and advantages will be apparent from the following detailed description of preferred embodiments taken in conjunction with the accompanying drawings.

DETAILED DESCRIPTION OF THE DRAWINGS

Figure 2:
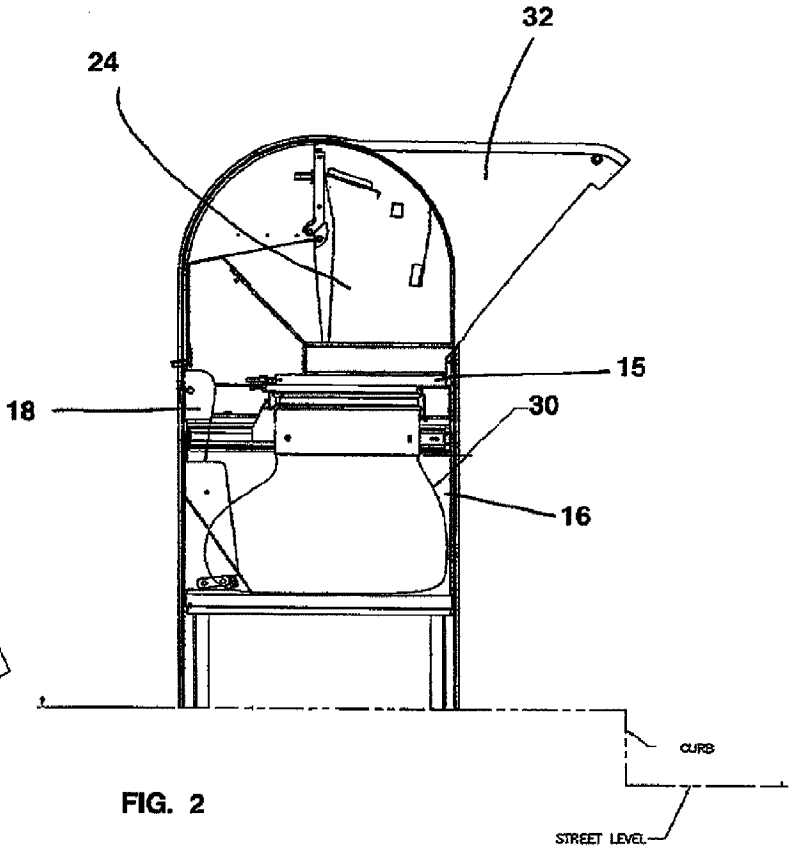
FIG. 2 is a schematic side view of the mail box of FIG. 1 with the side panel removed and showing the bag inside the box.
Figure 1:
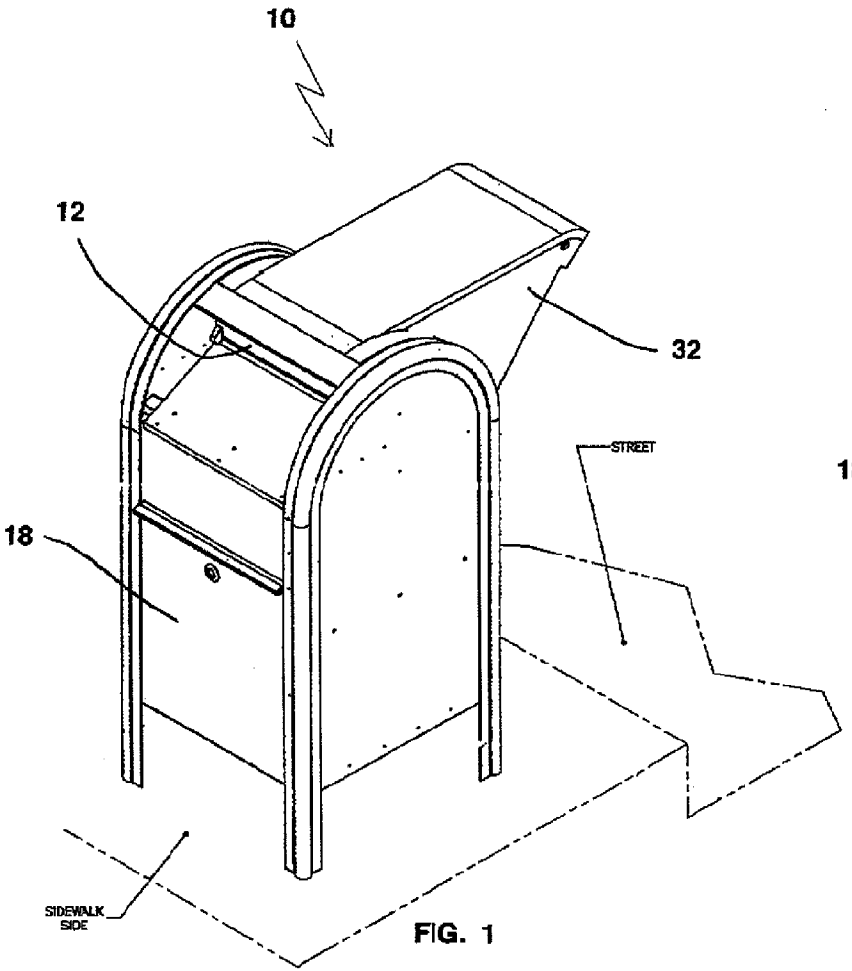
FIG. 1 is an isometric schematic view of a free standing mail box constructed in accordance with the present invention.

The present invention as used in connection with a free standing mail box is discussed below, and then the present invention as used in connection with a lobby mail box is discussed.

FIGS. 1-4 show a snorkel type mail box 10 including an upper deposit port 12, a snorkel 32, and a lower storage chamber 16 having an access door 18 shown in its closed position. There is also is a slidable shuttle assembly 20, which is located below the upper shutter holder 15. The shuttle assembly 20 is slidably mounted to mail box 10 by a pair of drawer slides 22 (See FIG. 3). This mounting of shuttle assembly 20 allows the assembly to be slid out of mailbox 10 for access.

There is an upper reception chamber 24 and lower storage chamber 16. A mail director 17 is designed to direct deposited mail items through an opening in the mail director and the upper shutter holder 15 and into a flexible container or bag 30 mounted to slidable shuttle assembly 20.

Figure 3B:
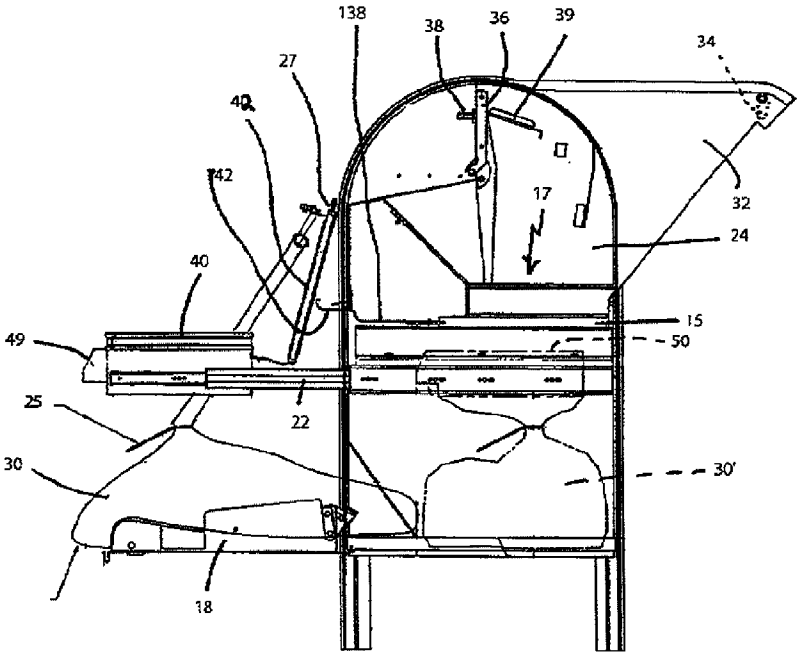
FIG. 3 a schematic side view of the mail box of FIG. 1 with the side panel removed and showing the bag and the transport mechanism in two positions, one inside the box (in phantom lines) and the other, outside the box (in solid lines) in the process of removal.
Figure 3A:
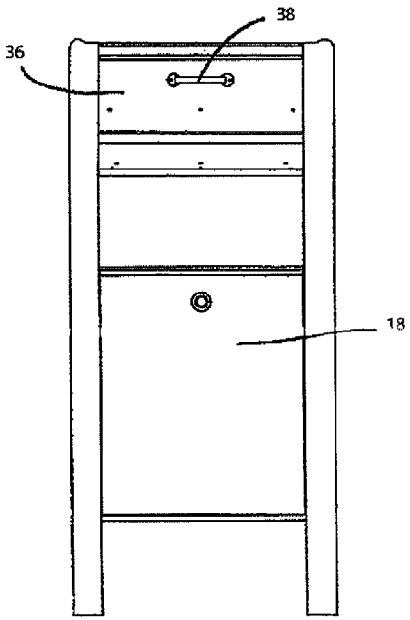

FIG. 3 shows the slidable shuttle assembly 20 extended outside of mail box 10 by means of slide rails or drawer slides 22. It is preferred that drawer slides 22 be adapted to extend outwardly more than their closed length when closed to allow adequate clearance of shuttle assembly 20 from mail box 10 as shown in FIG. 3, while allowing movement of shuttle assembly 20 to the rear of mail box 10 as shown in FIG. 2. Such drawer slides would typically include two movable sections on each side.

Flexible container 30 is shown in a closed condition with a cinching strap or member 25 closing a neck portion of container 30, and a draw cord 26 closing the peripheral edge of the opening of container 30. Draw cord 26 is shown connected to a draw cord hook 27 on upper frame 42.

Figure 4:
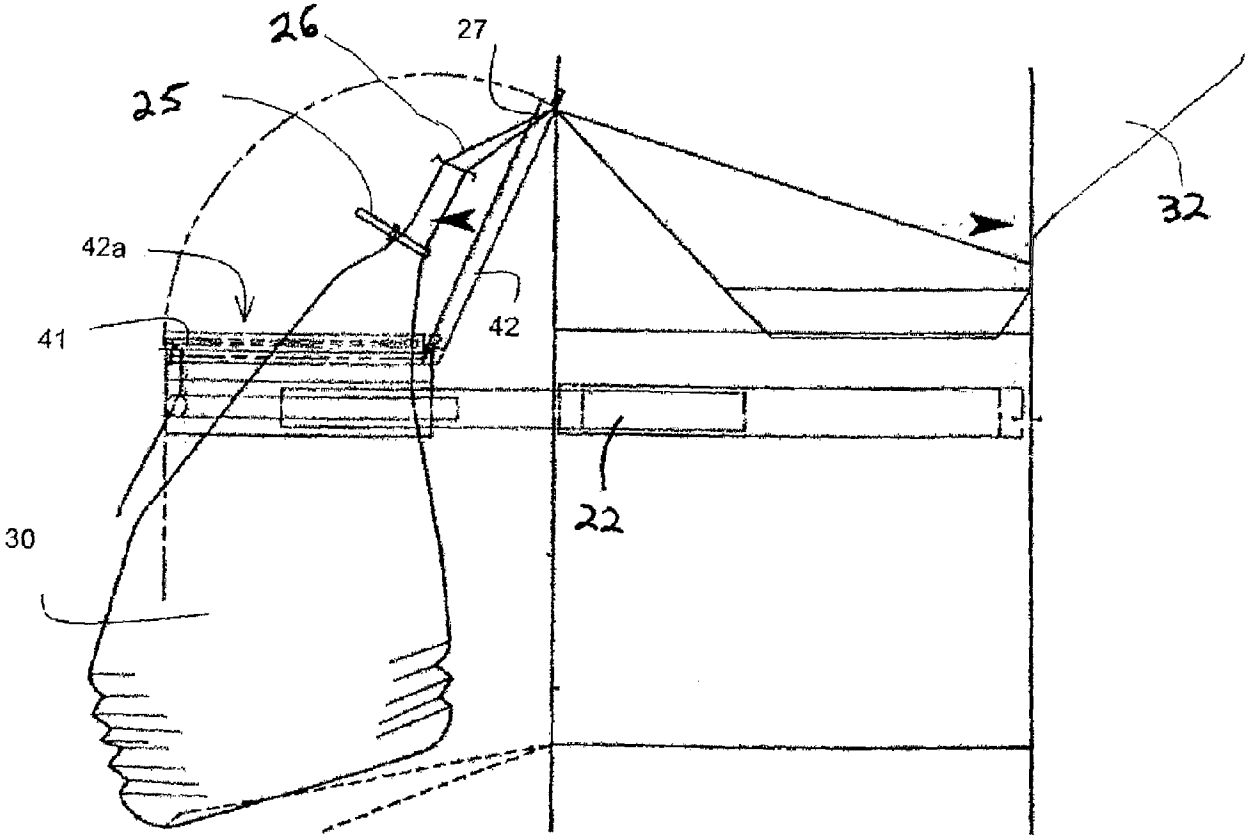
FIG. 4 is a schematic side view of the mailbox of FIG. 1 showing an enlarged portion.
Figure 15:
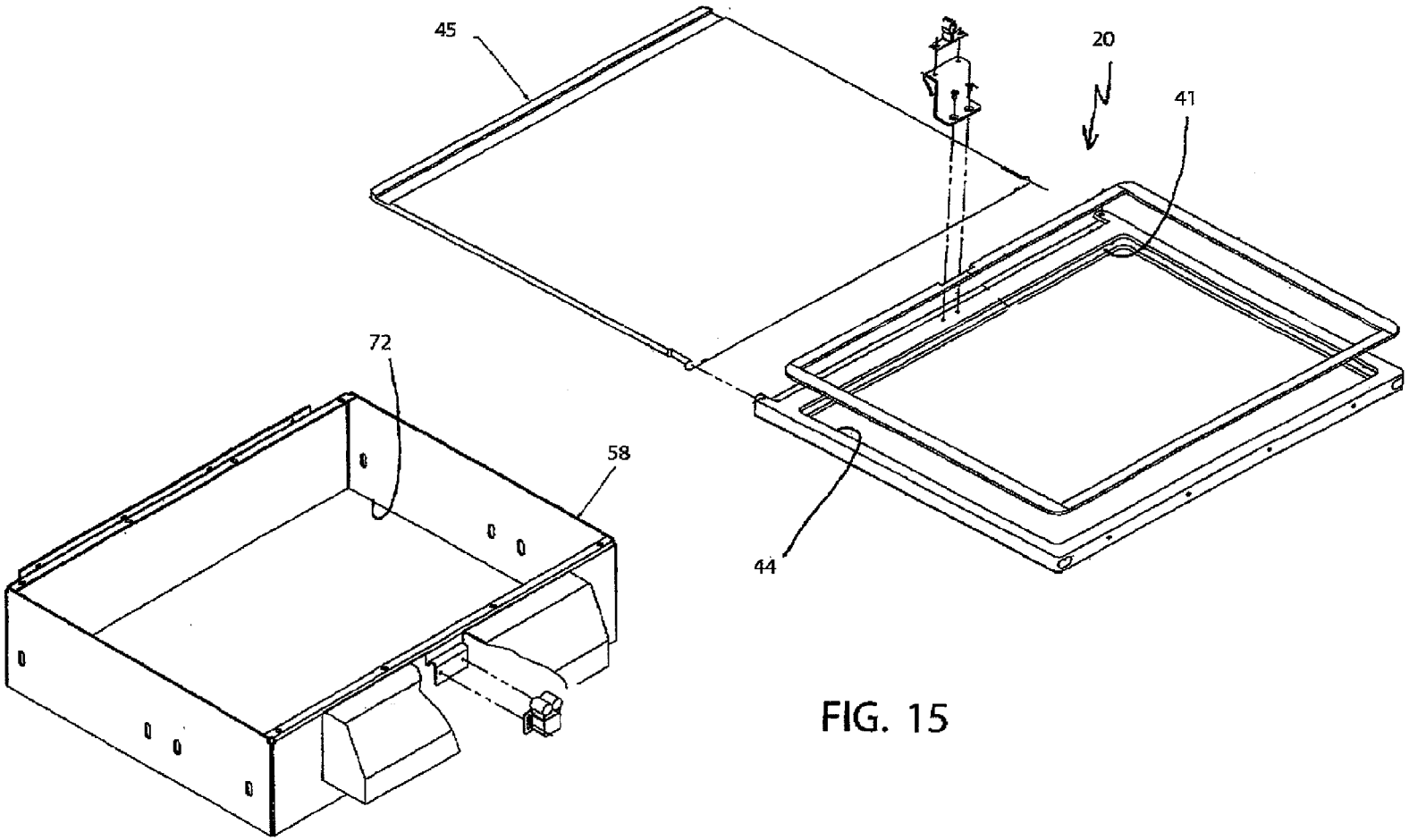
FIG. 15 is an exploded isometric view showing the clam shell, the shutter and the support.
Figure 16:
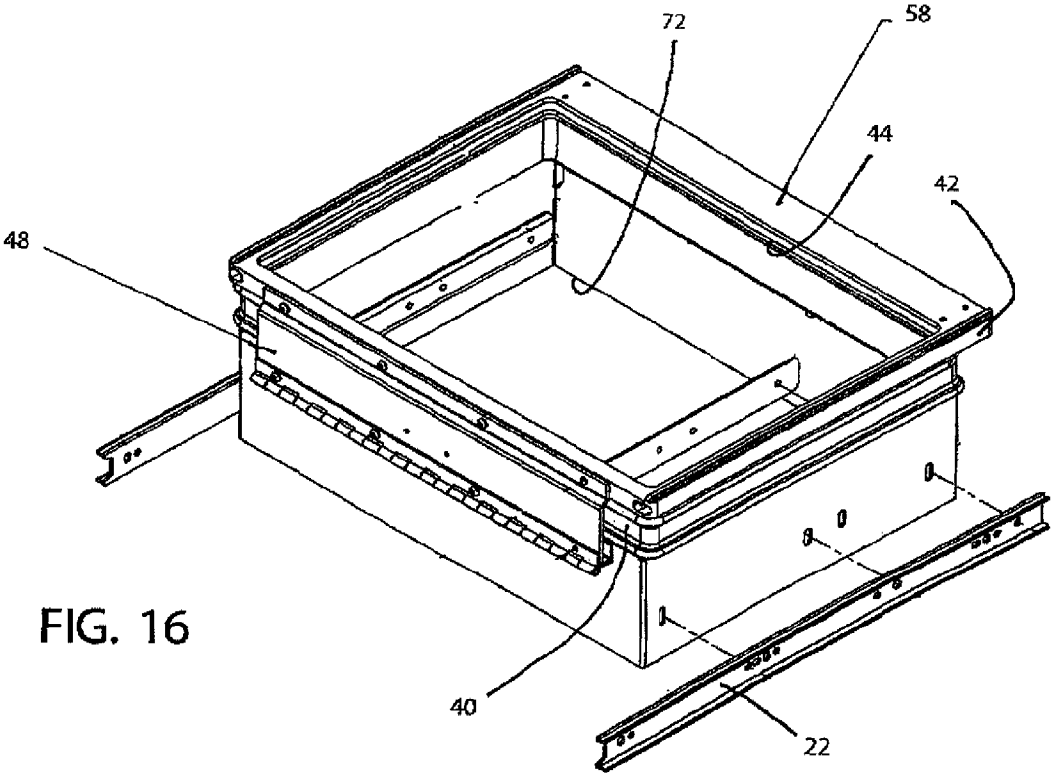
FIG. 16 is an exploded isometric view of the upper frame mounted on the frame support box.

FIGS. 4 and 15 show some details for upper frame 42. Upper frame 42 is shown both in an upwardly rotated position (solid lines) and in a lowered position 42*a* (dashed lines). The lower position 42*a* shows frame 42 including a central channel 41 for the containment of a shutter 45, which is adapted to close opening 44 of the frame 42, and opened end 50 (FIG. 3) of container 30. Shutter 45 may be constructed of any suitable transparent material to allow visual inspection into bag 30 while minimizing contaminant exposure.

FIG. 3 shows the bag 30 in both of its positions, one inside the mail box and the other removed from the mail box. FIGS. 3 and 4 shows a snorkel type of free standing mail box which is intended for use from the street side for an automobile. Some snorkel boxes (such as the one shown in FIG. 3) also have, in the opposite side, another entry zone for pedestrians on the sidewalk side who may also place article and letters into the same box. The box has a snorkel 32 which has a pivoted flap 34 (shown in dashed lines) that closes after an article is placed into the box to prevent back flow of air from the box into the ambient air. This is for the protection of users for the event that there is hazardous material inside the box to prevent it from blowing back into the face of a passenger.

There is a door 36 on the pedestrian or sidewalk side of the box which a walk-up user can access by pulling on the door handle 38 and the door pivots downwardly toward the user and the mail can be placed into a slot (not shown) in an access panel 39 attached to the door 36. This assembly is referred to as a deposit port 12 in connection with FIG. 1.

FIGS. 12-16 show the slidable shuttle assembly 20, which generally includes a lower frame 40 and an upper frame 42. Lower frame 40 is mounted to a frame support box 58 having a central opening 72 and this frame support box 58 is supported by drawer slides 22 through a pair of slide holders 46. Upper frame 42 is hinged to frame support box 58 by a hinge 48. The lower frame 40 is connected directly to the frame support box 58 so that the upper and lower frames are hinged with respect to each other, and in one embodiment may be directly hinged to one another. The lower frame 40 may be constructed with greater thickness than that shown in the drawings to provide greater rigidity and support. The frame support box 58 further includes a handle 49 to allow the shuttle assembly 20 to be pulled from mail box 10 as allowed by drawer slides 22.

In FIG. 4 the upper frame 42 is shown in both its raised position (solid lines) and its lowered position (dashed lines) 42*a*. Upper frame 42 include a catch or detent to maintain the raised position of upper collar 42 and prevent the weight of bag 30 from pulling upper frame 42 towards its lowered position 42*a*. This figures also shows the draw cord hook 27 mounted at the end of upper frame 42.

Flexible bag 30 includes an open end 50 having a peripheral edge, which extends through the center of lower frame 40 and around the top and outsides thereof. The upper frame 42 is located along the top and outside of lower frame 40 and pinches the periphery of open end 50 therebetween. Both the lower frame 40 and the upper frame 42 include a central opening 44 through which deposited mail items pass from reception chamber 24 to bag 30. In the closed position shown in dashed lines in FIG. 4, bag 30 is sealed by a flexible gasket located between upper frame 42 and lower frame 40.

Figure 6B:
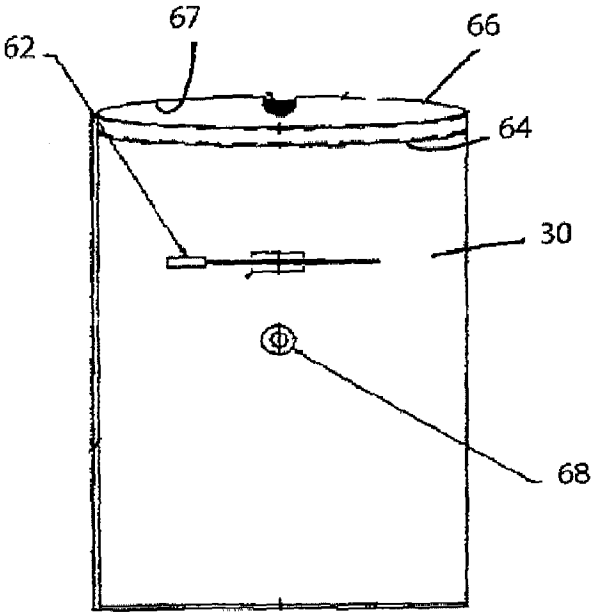
FIGS. 6A and 6B are front and back views, respectively, of one type of disposable mail bag.
Figure 6A:
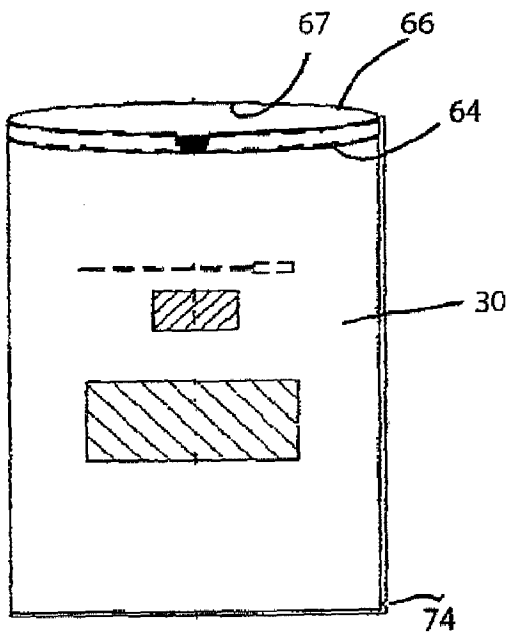
Figure 9:
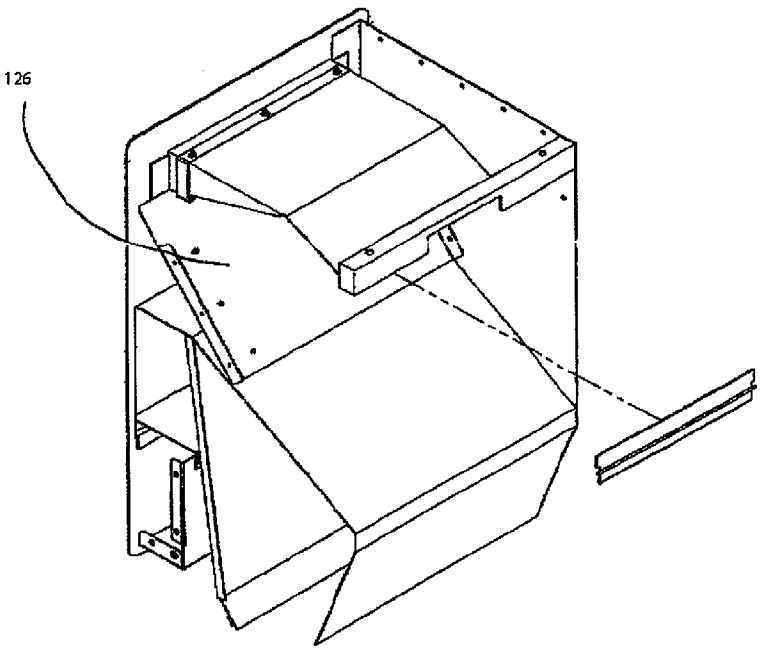
FIG. 9 is a rear isometric view of some of the internal structure of the lobby mail box.

FIGS. 6A and 6B show opposing sides of a flexible bag 30 adapted for use in conjunction with a mailbox 10 as container 30. Container 30 is preferably made of plastic and is shown in a flat folded orientation. Flexible bag may be made to be disposable (the bags may also be reusable if desired). Container 30 includes a cinching member 62 and an embedded draw cord 64. Draw cord 64 is located in close proximity to the peripheral edge 66 located around the opening 67 of container 30. Cinching member 62 is spaced slightly away from opening 66 to allow container 30 to be cinched close and effectively sealed while container 30 is still mounted within shuttle assembly 20, as shown in FIG. 3. Cinching member 62 may be formed by any suitable mechanism such as a cable tie or a Velcro strip.

Flexible container 30 also includes a vent 68 to allow air to be expelled from container 30 once cinching member 62 has closed container 30. To prevent the dispersal of contaminants with this expelled air, vents 68 may be covered with a suitable filter, such as a HEPA filter, or vent may be attached to a separate filter system. This container may be disposable and constructed with a tear area or notch 74 for tearing the container in the area of the notch to quickly empty the contents of the container without the need to open the draw cord or the cinching member.

Figures 5A, 5B:
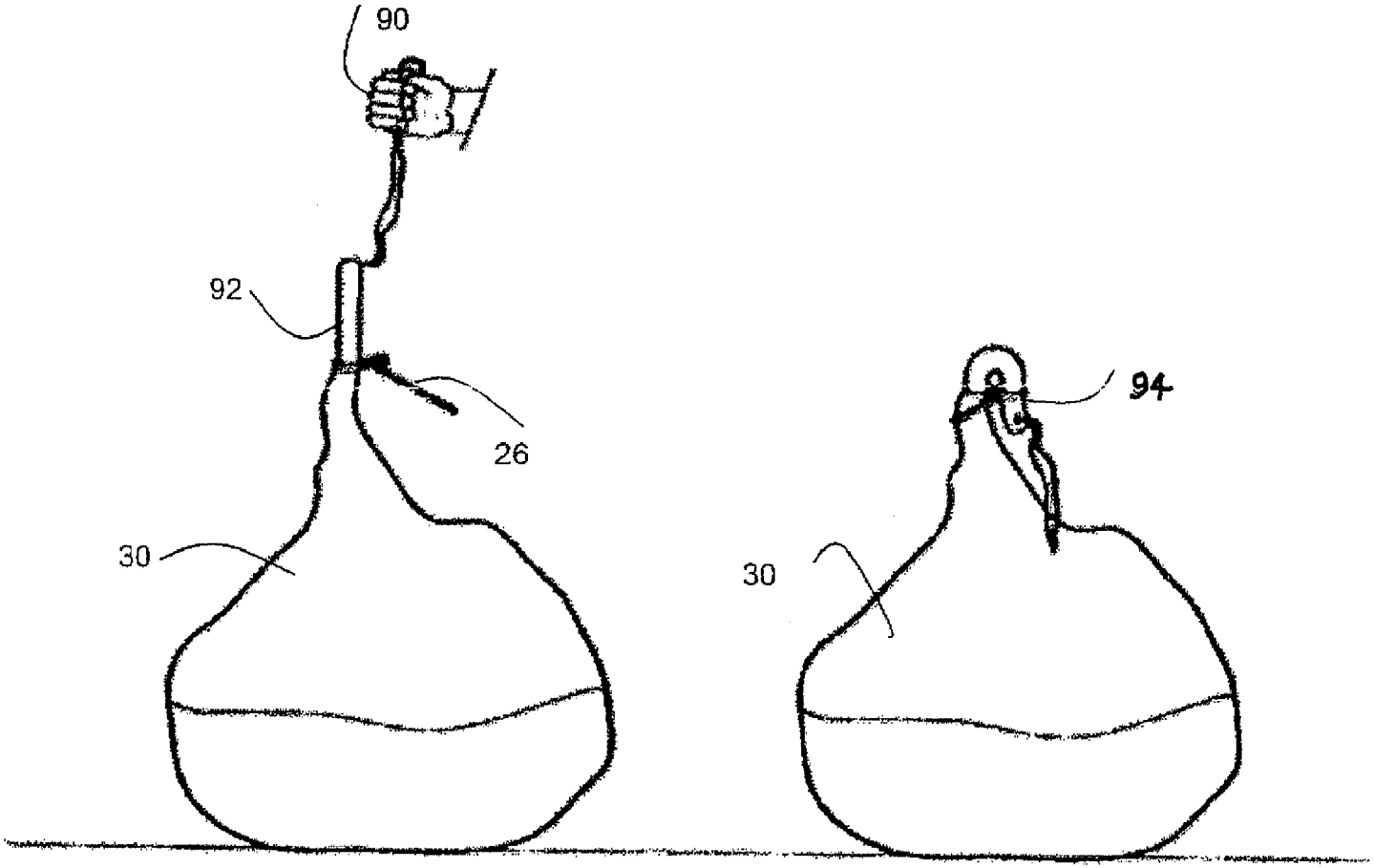
FIGS. 5A and 5B are schematic views of a flexible bag after removal from the mail box of FIG. 1.

In operation, mail box 10 is intended to allow the safe closure of flexible container 30 while minimizing exposure of a mail collector to any contaminants located within flexible container 30. In removing flexible container 30 from mail box 10, a collector would first open access door 18. Then, shutter 45 would be rotated upwardly along an arc and slid into channel 41 (FIG. 15) to close the opening 44 (FIG. 4) in upper frame 42. Then, shuttle assembly 20 would be slid out of mailbox 10 to the position shown in FIG. 3. At this point, cinching strap 25 would have already been used to provide the first seal of flexible container 30. Once container 30 is closed, upper frame 42 is raised away from lower frame 40 causing tension on draw cord 26 and the complete closure of flexible container 30. In this condition, flexible container 30 may be removed from mail box 10 as shown in FIG. 5A, wherein a collectors' hand 90 is pulling on draw cord 26. Cinching member 25 may include a double cinching function such that the neck 92 of container 30 which extends beyond cinching member 25 may be folded back and double cinched, as shown at 94 in FIG. 5B. Such a double cinching function may be accomplished by any suitable means, such as with a cable tie having a double eyelet at one end.

Figure 7:
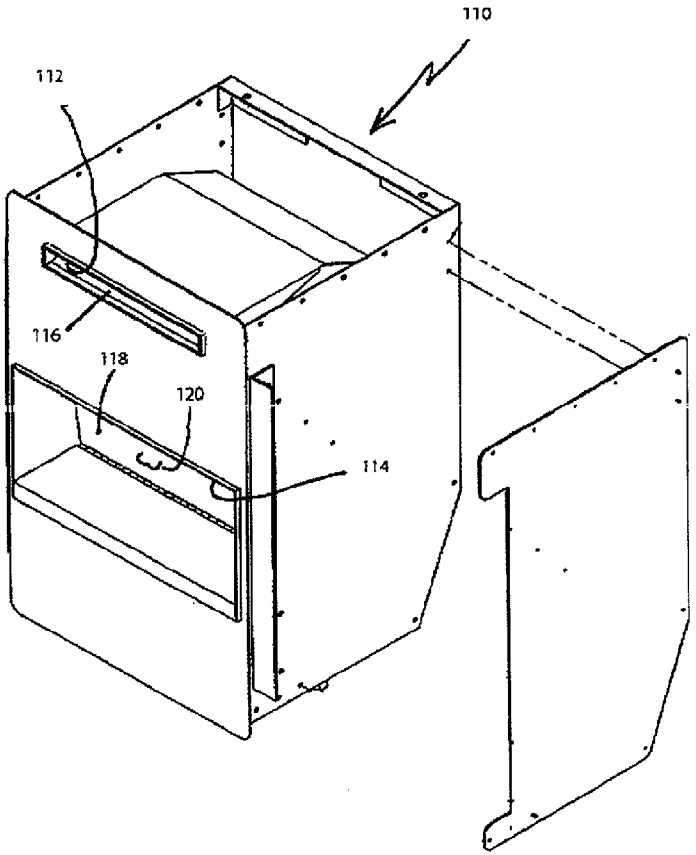
FIG. 7 is a front isometric view of a lobby mail box having features similar to those of the snorkel box of FIGS. 1-4.
Figure 10:
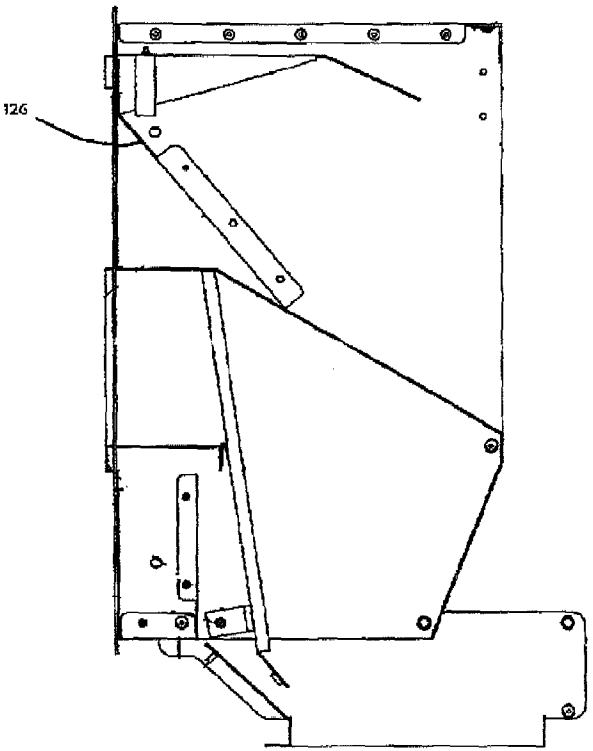
FIG. 10 is a side view of the lobby mail box with its side panel removed.
Figure 8:
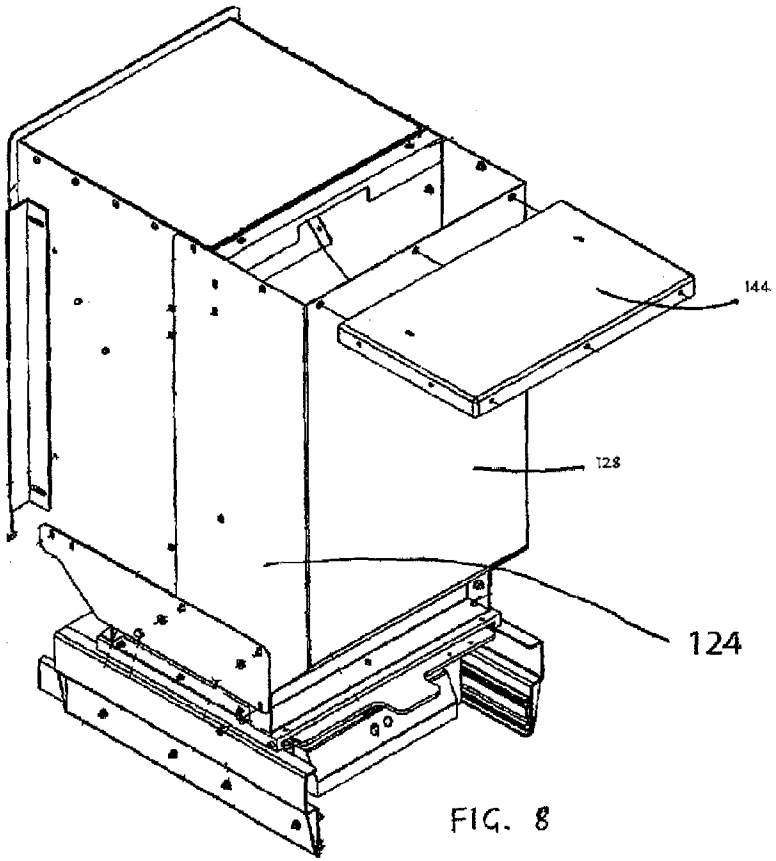
FIG. 8 is a rear isometric view of the lobby mail box of FIG. 12.

FIGS. 7-10 show a lobby mail box 110 that provides a sealed path from the customer letter drop slot or package drop slot of a lobby drop station to a slidable shuttle assembly as described. This can be a current lobby drop box which is modified or a new one built as described here and which operates as described herein. The lobby mail box 110 has two deposit ports, one 112, for mail and the other 114, for packages. Deposit port 112 has a door 116 which is hinged at the top which opens by pressing a piece of mail against it, and then closes by gravity after the mail passes through. The deposit port 114 for packages is larger than port 112 and has a door 118 with a handle 120 so that a user pulls the handle down which pulls the door down as shown in FIG. 7 and places a package onto the door. The door is pivotally mounted in the middle so that as the door is opened to receive the package a basically horizontal platform is presented onto which the package is placed. The back of the door extends rearwardly to the back of the box. When the user closes the door, the package slides down the back and drops by gravity through the interface and into the collection area described in more detail below.

The letter drop slot can be altered, if necessary, to have the swinging flap or door 116 that is pushed to open it during the customer's mail insertion process return to its original position. The purpose of this is to prevent the possibility of a back draft of air, carrying a contaminate back into the customer's face.

An additional mail path cover 124 is fitted over the back (non-customer side) of the lobby box. (See FIG. 8.) This is to keep the inducted mail piece completely isolated from Postal or other workers that are in the area. Also, the top lid 144 is transparent so that personnel can see whether there are any problems such as jams.

It may be necessary to add an internal angled guide 126 to allow the letter mail to be guided in a manner such that it does not hang up or lodge inside the lobby box and that it travels a smooth path to the mail path cover. It may be necessary to remove the current hinged back door and associated hardware (such as door closure magnets or brackets) in those situation where the present invention is added as a retrofit to an existing lobby mail box. FIGS. 7-10 show the lobby mail box 110 can be connected to a wall in the usual manner.

The mail path cover 124 can be fabricated or molded of a clear material such as polycarbonate. It can have an access door 128 mounted on hinges (not shown) in the unlikely event that a mail jam occurs and it needs to be physically cleared by a postal or other authorized person. The bottom of the mail path cover and joining the lobby box is a mail director 132 having a central opening 134 that acts as a funneling device, to direct mail as a customer deposits it, into the center of the slide access mechanism as described above in connection with FIGS. 1-4 in connection with a mail box of the tree standing type. The mail director 132 also acts to direct parcels inducted through the lobby box parcel door into the same mail container. The mail director 132 may have a flange that surrounds the central opening 134 on all sides and is mounted to a convenient surface, such as a wall or a counter.

Figure 11:
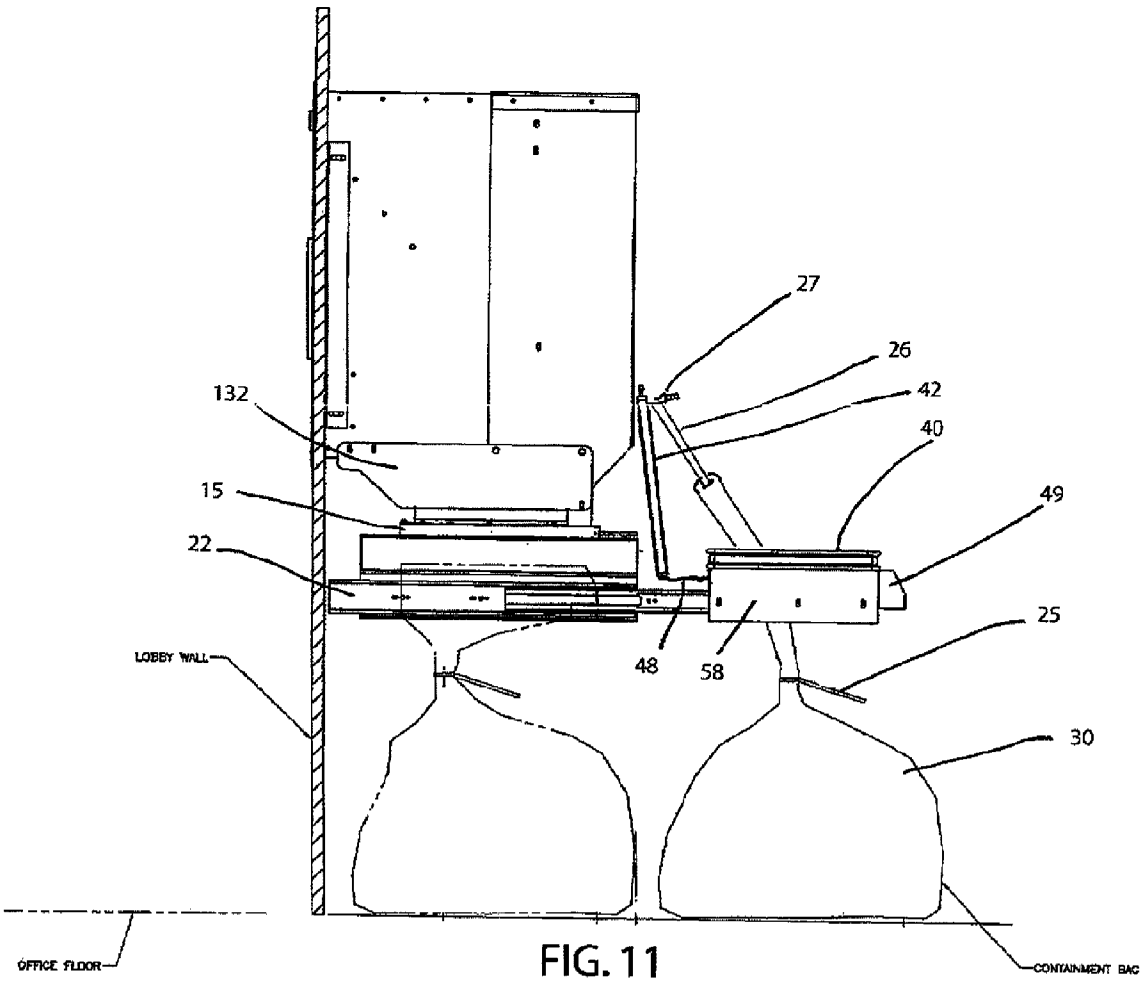
FIG. 11 is a schematic side view of the lobby mail box showing the bag and transport mechanism in two positions, one inside the box (in phantom lines) and the other, outside the box (in solid lines) in the process of removal.
Figure 12:
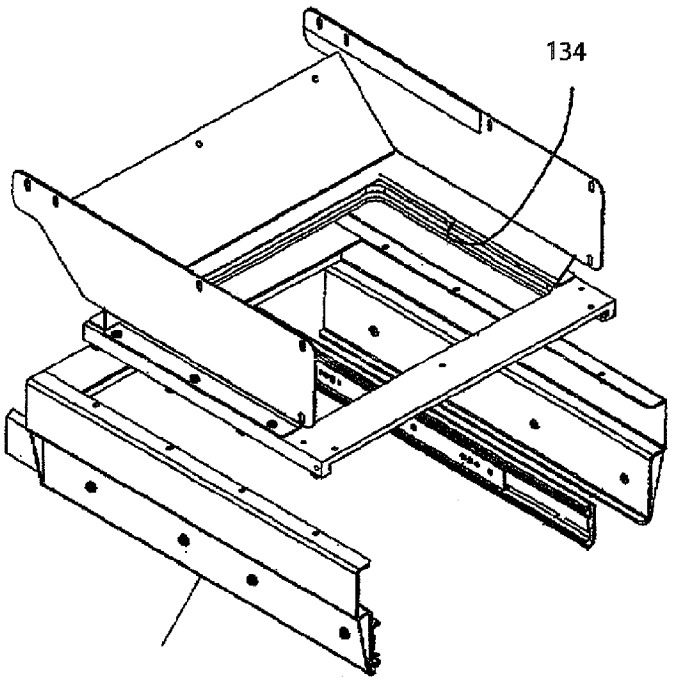
FIG. 12 is a partially exploded isometric view of the transport mechanism.
Figure 13:
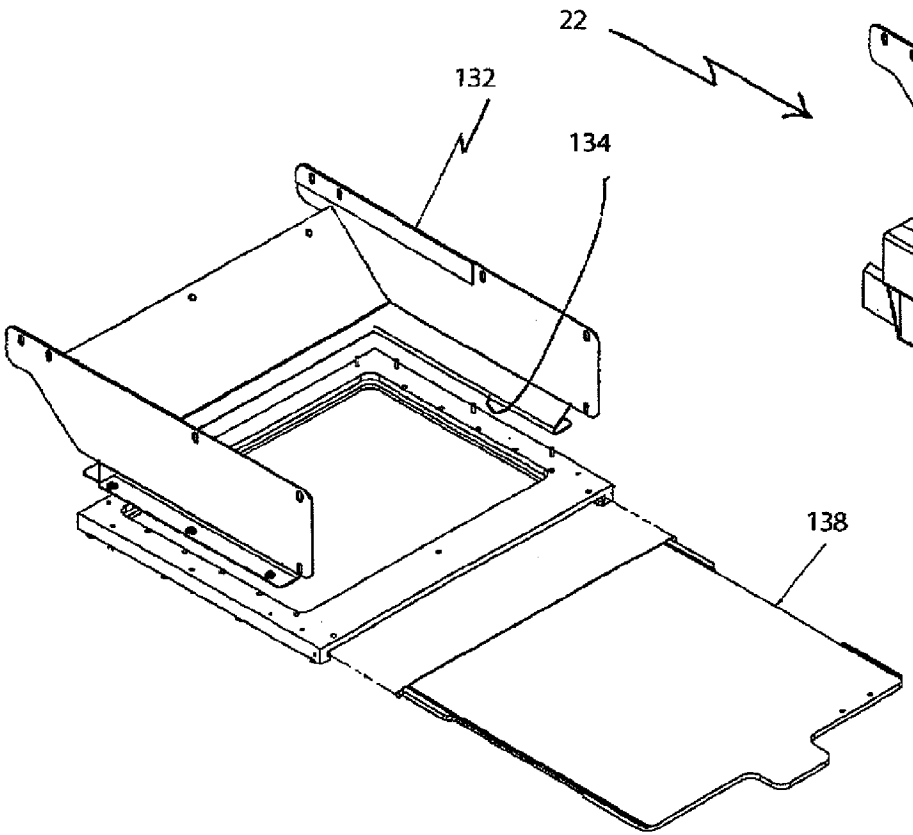
FIG. 13 is a partially exploded isometric view of the transport mechanism showing the shutter and the guide chute.
Figure 14:
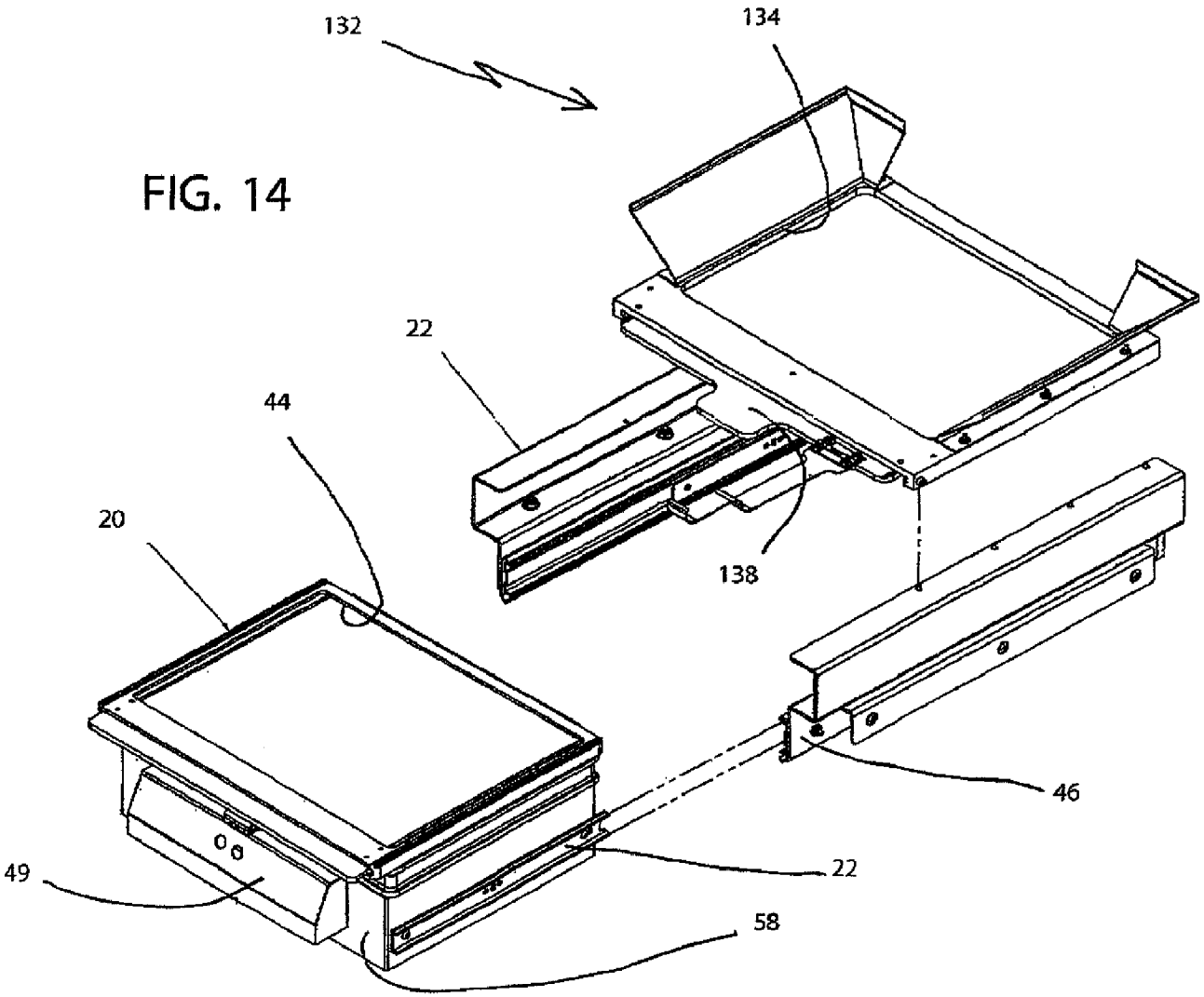
FIG. 14 is a partially exploded isometric view of the transport mechanism showing the guide chute, the railings and the clam.

The slide access mechanism is shown in FIGS. 11, 12 and 14 in connection with the lobby box (and described in more detail above in connection with a free standing mail box as shown and described in FIGS. 1-4). It is an assembly on slides 22 that, in the closed position, accepts mail as funneled by the mail director 132 and passes it via gravity to the mail container 30. It also supports and holds the mail container open in a manner such that it can accept mail in an unimpeded manner.

The upper clamshell 42 has a sliding shutter 45 plate incorporated into it that when pushed closed will seal the mail container prior to the removal process of the mail container at collection time. This helps to prevent any air flow that may contain suspended contaminates from escaping the mail container while the operator is sealing the mail container.

In both the free standing mail box of FIGS. 1-4 and the lobby box, there can also be a second or upper shutter plate 138 in-between the slidable shuttle assembly 20 and the mail director 132 (See FIGS. 3 and 15). This is beneficial in the event that mail is being inducted by a customer at the same time the mail container is being serviced by a postal worker. The clamshells and shutter plate have seals to help ensure that possible contaminates from within the mail container, stay within the mail container. The shutter plate 138 can be made of a transparent material to help view the mail internal to the mail container prior to sealing of the mail container. The shutter plate 138 also can be hinged to allow it to stow in a near vertical position when the system is in use for collection. The end of the shutter plate 138 has a tab 142 which is flexibly attached to the shutter. When the shutter is in the closed position as shown in FIG. 3, tab 142 extends outwardly of the box. Thus, If the postal worker emptying the box forgets to open the shutter 138 (in order to allow mall deposited by a customer, to flow through the mail director into the collection container), the door 18 cannot be closed, and this acts as a reminder to the worker that the shutter is still preventing mail from flowing from the deposit ports to the collection container. The shutter is opening by pulling it out, at which point the outer ends pivots to a vertical position and it fits between the door and the internal structure of the box.

The slidable shuttle assembly 20 strategically positions a mail container 30 directly under the lobby drop box. It is comprised of a set of industrial drawer slides 22 and a supporting bracket. The drawer slides 22 are appropriately load rated and have sufficient cycle rating to last the lifetime of a collection box. This allows the servicing of the mail container to take place in the necessary ergonomic manner. The drawer slides 22 are arranged so that they can extend further than a normal slide. For example, a 20" slide can typically extend 20" whereas the slide which can be used in this mechanism can extend 25". This additional travel provides for good ergonomics in the mail container removal and replacement processes. Hard fastened directly to the drawer slides is a supporting bracket. The supporting bracket spans the two drawer slides and provides a means of rigidly attaching the containment interface to the drawer slides. The slide access mechanism 20 can firmly seat closed and a magnet or some other detent type device will be used to accomplish this.

The mail container 30 is an engineered bag that may be reusable or disposable. It has many necessary features to allow it to work as a system component of the Collection Mail Containment System (CMCS). The mail container is made of a rugged but flexible non-porous material. Attached to the upper portion of the mail container is a cable tie or similar device that is used to pinch the bag closed and seal it. The cable tie can have a double-headed end such that it can be looped twice. As the cable tie is being closed air will want to exit the mail container. The shutter plate blocks the exit of air from the top of the bag at the container interface so the air will exit through a built in HEPA filter in the mail container. It acts as an air vent but also prevents micron-sized particulates from exiting and they can contained within the mail container.

As an option, instead of the mail container having a built in HEPA filter, a replaceable flush fitting HEPA filter element can be incorporated into the shutter plate and periodically be replaced as deemed necessary. With the cable tie drawn completely closed the clam shell assembly can now be opened for removal of the mail container. At the top of the mail container is a draw string that is of a predetermined length such that it can be looped over a handle of feature of the clam shell assembly. By doing such, the motion of opening the clam shell assembly will allow the draw string to close off the top of the bag. This prevents an operator from physically touching the upper inside area of the mail container that may have had a contaminated article pass over it. At this point the draw string can be grasped and the mail container removed from the mailbox. With the mail container removed a second seal can be made to finalize the closure of the mail container. This is accomplished by bending the drawn closed end of the mail container downward in a gooseneck fashion. The second slot of the double ended cable tie can now be utilized to perform a second looped closure.

It will now be apparent to those skilled in the art that other embodiments, improvements, details, and uses can be made consistent with the letter and spirit of the foregoing invention and within the scope of the present claims.

The invention claimed is:

1. A retrofit assembly for a mail box in the form of a container having a deposit port at the upper end and a collection chamber at the lower end, at least one door at the upper end for mail to be placed into the deposit port, the assembly comprising:

a normally open sealable bag for the collection chamber for receiving mail and for being sealed when the mail is to be removed from the container;

a bag holder constructed and arranged to hold the bag in place so that in a first position, mail placed into the deposit port falls downwardly through the bag holder and into the bag in the collection chamber, said bag is preliminarily sealed while in the first position, and in a second position, the bag is more securely sealed and removed from the bag holder; and a slide assembly for moving said bag holder between the first position and the second position.

2. An assembly as defined in claim 1 wherein the bag holder is movable from said first position in which the bag is within the collection chamber to the second position in which the bag is outside of the collection chamber.

3. An assembly as defined in claim 2 wherein the bag holder includes two open frames hinged together for removably holding the top of the bag.

4. An assembly as defined in claim 2 wherein the bag holder has an upper frame and a lower frame which are arranged so that the top of the open bag is clamped between the upper and lower frames to hold the open bag in place in the collection chamber.

5. An assembly as defined in claim 4 wherein there is a first shutter in the upper frame movable from an open position to a closed position to prevent back flow of particulates when the bag is preliminarily sealed.

6. An assembly as defined in claim 2 wherein there is a first shutter movable from an open position to a closed position to prevent back flow of particulates when the bag is preliminarily sealed, and there is a second shutter movable between two positions and which, in a first position, allows mail that is placed into the deposit port to descend into the collection chamber, and, in a second position prevents mail placed into the deposit port from descending into the collection chamber.

7. An assembly as defined in claim 6 further comprising a second door for the collection chamber which is opened to remove the sealed bag.

8. An assembly as defined in claim 7 wherein said first shutter has a tab constructed and arranged with the door so that the door cannot be closed when the first shutter is closed.

9. An assembly as defined in claim 8 wherein the mail box is free standing.

10. An assembly as defined in claim 6 wherein there are a plurality of the deposit ports arranged so that they all direct deposited articles into the open bag in the collection chamber.

11. An assembly as defined in claim 6 wherein the mail box is a wall mounted box.

12. An assembly as defined in claim 1 wherein there is a shutter movable from an open position to a closed position to prevent back flow of particulates when the bag is preliminarily sealed.

13. An assembly as defined in claim 1 wherein said slide assembly includes drawer slides for moving between the first and second positions.

14. An assembly as defined in claim 1 wherein the slide assembly is arranged to hold the bag and is movable between said first position and said second position so that the bag is movable outside the mailbox.

15. An assembly as defined in claim 1 wherein said bag holder includes two open frames hinged together for removably holding the top of the bag in an open position and arranged to hold the bag normally open when the bag holder is in its first position, in which the bag is preliminarily sealed and in the second position, the bag is more securely sealed and removed from the bag holder.

16. A method of collecting mail in a mail box and removing it therefrom in a manner which contains and reduces exposure to hazardous particulates, comprising the steps of:

a. providing the mail box in the form of a container with at least one deposit zone at the upper end and a collection chamber in a lower zone;

b. providing at least one normally closed door at the deposit zone and moving the door when mail is to be deposited into the deposit zone;

c. providing an open bag in the collection chamber for receiving mail deposited into the deposit zone, and providing a bag holder;

d. preliminarily sealing said bag while it is in the collection chamber;

e. removing the bag from the collection chamber f. more securely sealing the bag;

g. removing the bag from the bag holder; and h. placing another open bag in the collection chamber.

17. The method as defined in claim 16, wherein after step c, preventing mail from entering the bag when the bag is to be removed from the collection chamber; and after step h, allowing mail to enter the bag when deposited into the deposit zone.

18. The method of claim 16 further comprising the step of:

i. providing an indication to a person removing the bag that mail is being prevented from entering the bag when deposited into the deposit zone.

* * * * *